US005522712A

United States Patent [19]

Winn

[11] Patent Number: 5,522,712

[45] Date of Patent: Jun. 4, 1996

[54] LOW-POWERED COOLING FAN FOR DISSIPATING HEAT

[76] Inventor: Ray Winn, 320 W. Carob St., Compton, Calif. 90220

[21] Appl. No.: 164,080

[22] Filed: Dec. 8, 1993

[51] Int. Cl.[6] ..... F04B 19/00

[52] U.S. Cl. ..... 417/436; 417/410.2; 415/125; 416/3; 310/25

[58] Field of Search ..... 417/436, 410.2; 415/125; 416/3; 310/21, 25, 29

[56] References Cited

U.S. PATENT DOCUMENTS

| | | | |
|---|---|---|---|
| 2,152,243 | 3/1939 | Daiger | 417/436 |
| 4,063,826 | 12/1977 | Riepe . | |
| 4,498,851 | 2/1985 | Kohm et al. . | |
| 4,595,338 | 6/1986 | Kolm et al. . | |
| 4,684,328 | 8/1987 | Murphy . | |
| 4,780,062 | 10/1988 | Yamada et al. . | |
| 4,834,619 | 5/1989 | Walton . | |
| 4,923,000 | 5/1990 | Nelson . | |

FOREIGN PATENT DOCUMENTS

| | | | |
|---|---|---|---|
| 2194238 | 2/1974 | France . | |
| 2528500 | 12/1983 | France . | |
| 596768 | 5/1934 | Germany . | |
| 1528726 | 9/1970 | Germany . | |
| 61-154470 | 7/1986 | Japan . | |
| 62-131997 | 6/1987 | Japan | 417/410.2 |
| 2210414 | 6/1989 | United Kingdom . | |

*Primary Examiner*—Charles Freay
*Attorney, Agent, or Firm*—Robbins, Berliner & Carson

[57] ABSTRACT

A cooling fan for dissipating heat requiring relatively little electrical power to operate. The fan includes a fan blade, constructed from flexible metal or plastic, anchored at one end and having a permanent magnet mounted at the other end. An external drive mechanism, such as a position sensor or an oscillator, provides a drive pulse to the coil. The fan blade is placed in motion by energizing a coil which is disposed about a core constructed of magnetically permeable material and positioned adjacent the magnet. Upon energization of the coil, the magnet mounted on the blade reacts to the magnetic field generated by the coil, causing the blade to move away from the coil. When the magnet, due to the flexibility of the fan blade, moves back towards the coil, a voltage is induced in the coil by the magnet, thus causing current to flow through the coil to apply a kick or power pulse of magnetic energy to the magnet. This process continues as the blade moves from side to side. The fan blade thus functions as a resonant mechanical oscillator and as it moves, air is caused to move over the device to be cooled.

22 Claims, 6 Drawing Sheets

FIG. 8
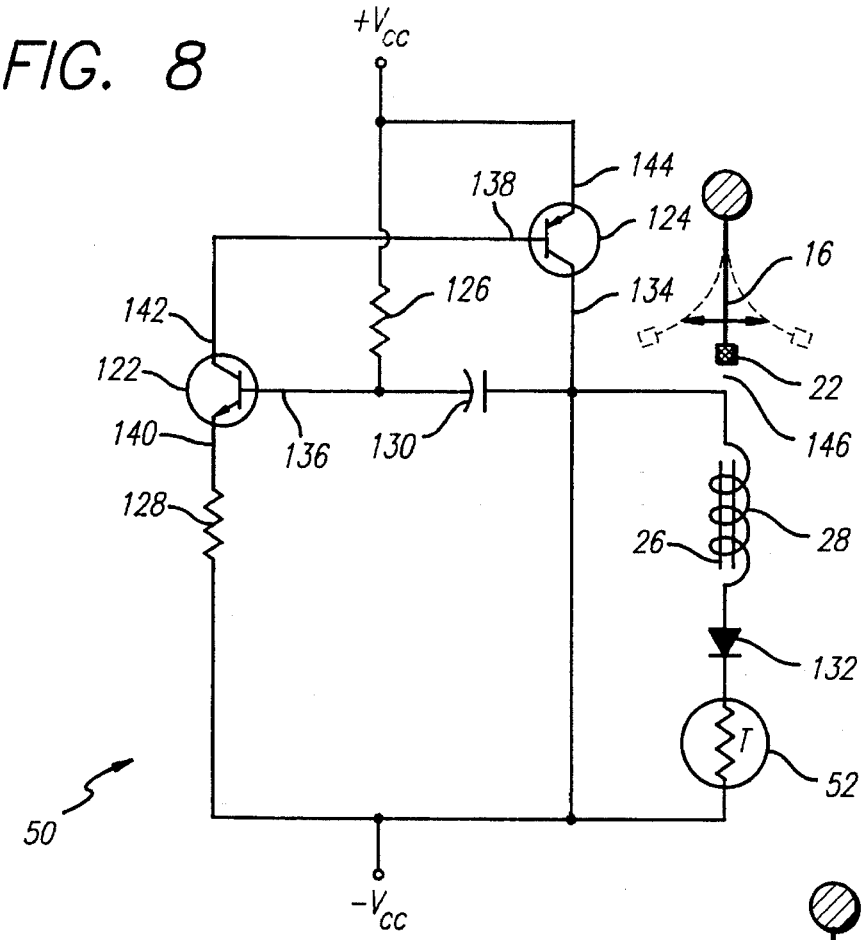
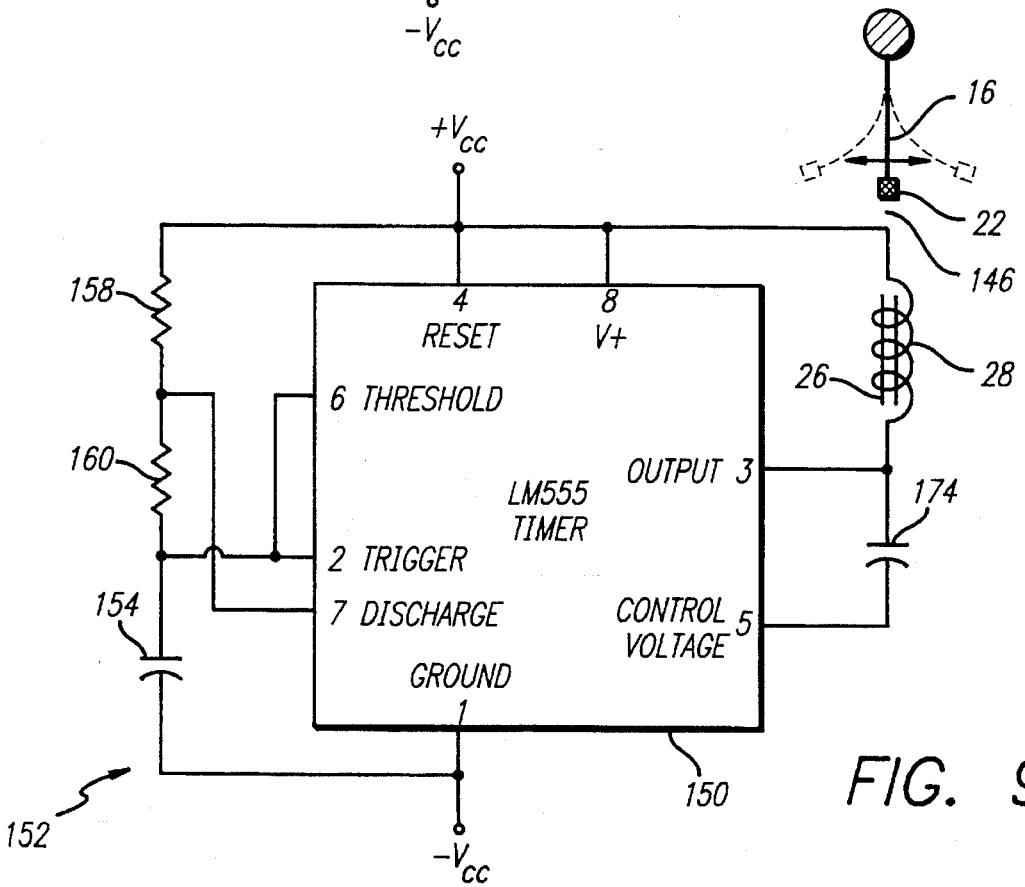
FIG. 9

FIG. 10
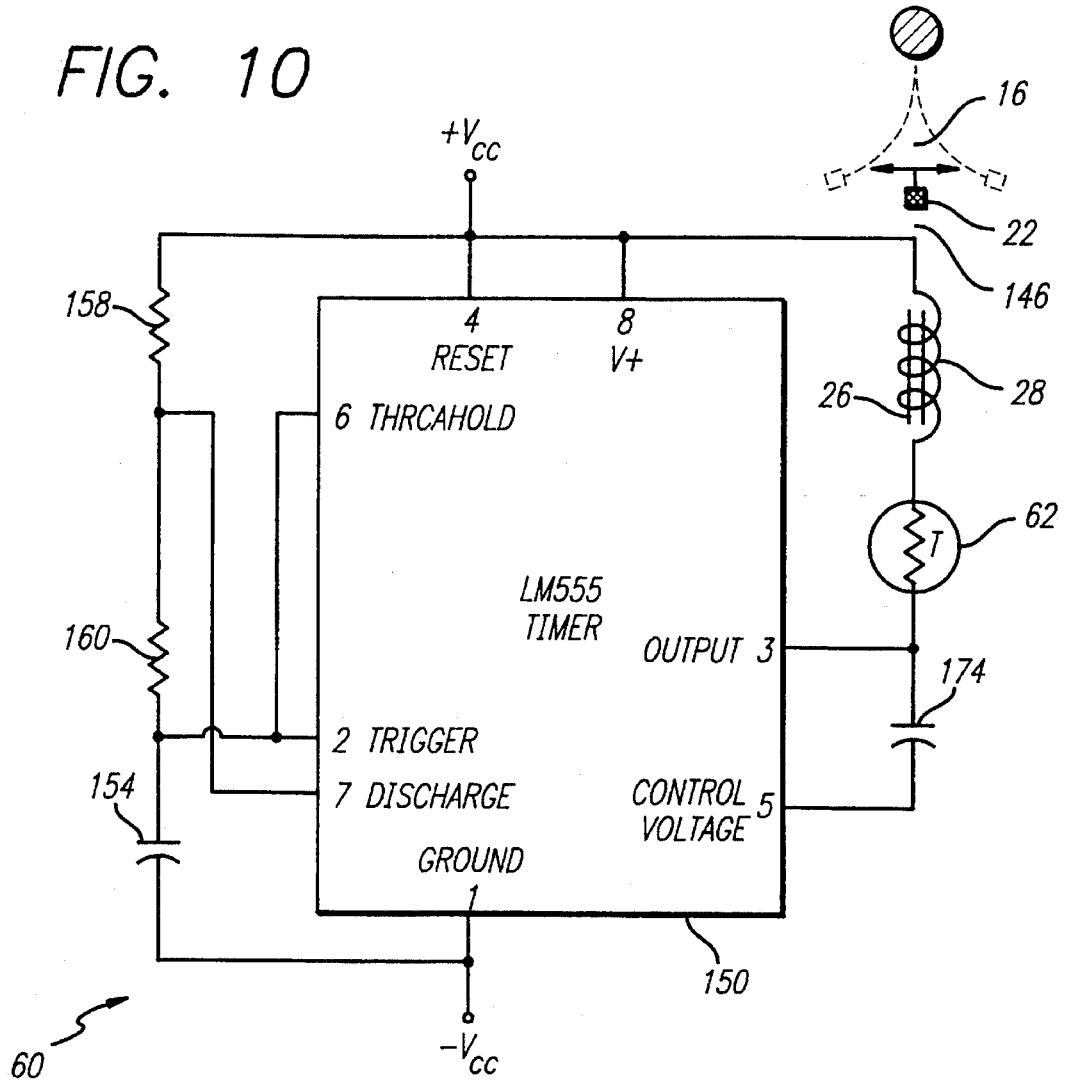
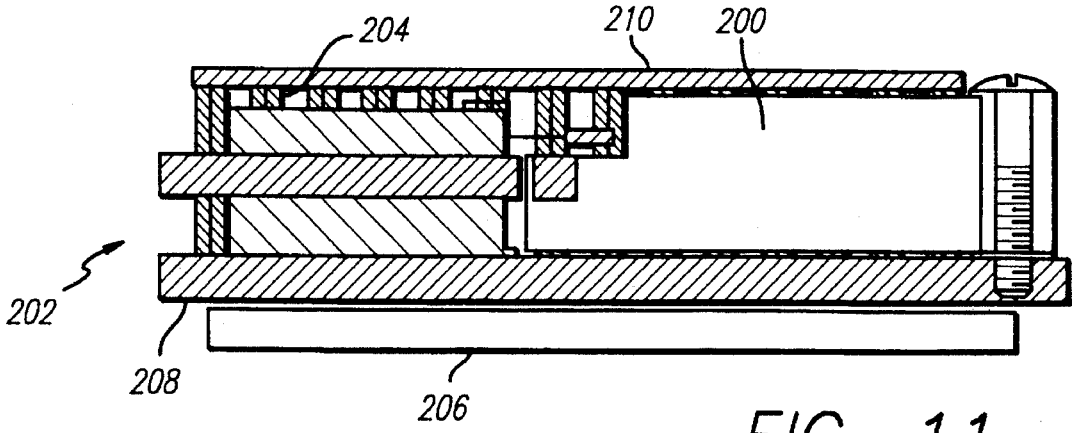
FIG. 11

LOW-POWERED COOLING FAN FOR DISSIPATING HEAT

FIELD OF THE INVENTION

The present invention relates to cooling fans for dissipating heat.

BACKGROUND OF THE INVENTION

A substantial amount of heat is typically generated by devices which operate at high power or speeds. In most cases, the heat must be dissipated to preclude malfunction of the device. Conventionally, to dissipate heat, fans have been used to blow cool air past the surface of the device. However, conventional fans typically draw a large amount of power and thus are not readily adaptable for use in small devices, such as microprocessor devices found in lap tap computers. For example, when semiconductor devices and particularly those used in microprocessors are operated at relatively high speeds, a substantial amount of heat is typically developed. The heat must be dissipated to preclude malfunction of the semiconductor devices. In the past, heat sinks have been utilized for mounting semiconductor devices to dissipate heat generated by them. This technique has been utilized particularly where power devices such as rectifiers or power transistors have been utilized. In many instances, such heat sinks would also include fins for increasing the total surface area from which conduction and radiation into the air can take place. Cooling is enhanced by the use of fans that blow cool air past the surface of the chassis and/or heat sink to dissipate the heat. However, such fans typically draw a large amount of power and thus are not readily adaptable for use in microprocessors and particularly in microprocessors which are transportable, such as in lap top computers.

With respect to dissipating heat in larger devices, such as refrigerators and power transformers, the large amount of power drawn by existing fans renders many of the fans uneconomical. For example, the cost for providing cooling to a vertical fin array on a residential power transformer, such as those used for single or multiple household power distribution for underground utilities, is substantial.

Thus, a need exists for a fan for dissipating heat which requires relatively little electrical power to operate.

SUMMARY OF THE INVENTION

The preceding and other shortcomings of prior art devices are addressed and overcome by the present invention which provides a cooling fan for dissipating heat generated by a device to be cooled having a flexible fan blade having first and second ends, a mounting means affixed to one end of the blade for anchoring the blade over the device, a permanent magnet mounted on the opposite end of the blade, and a coil disposed about a core means constructed of magnetically permeable material and positioned adjacent the permanent magnet for providing a magnetic force to move the blade from side to side when the coil is energized thus cooling the device.

The foregoing and additional features and advantages of this invention will become further apparent from the detailed description and accompanying drawing figures that follow. In the figures and written description, numerals indicate the various features of the invention, like numerals referring to like features throughout for both the drawing figures and the written description.

BRIEF DESCRIPTION OF THE DRAWINGS

FIG. 8 is a schematic diagram illustrating an alternative embodiment of an astable oscillator circuit for providing power to a cooling fan in accordance with the principles of the present invention;

FIG. 9 is a schematic diagram illustrating a 555 Timer astable multivibrator circuit for providing power to a cooling fan in accordance with the principles of the present invention;

FIG. 10 is a schematic diagram illustrating an alternative embodiment of a 555 Timer astable multivibrator circuit for providing power to a cooling fan in accordance with the principles of the present invention;

FIG. 11 is a side elevational view of a cooling fan positioned within a heat sink for enhancing dissipation of heat constructed in accordance with the principles of the present invention.

DETAILED DESCRIPTION OF PREFERRED EMBODIMENTS

The present invention provides a cooling fan for dissipating heat generated by a device to be cooled having a flexible fan blade having first and second ends, a mounting means affixed to one end of a blade for anchoring the blade over the device, a permanent magnet mounted on the opposite end of the blade, and a coil disposed about a core means constructed of magnetically permeable material and positioned adjacent the permanent magnet for providing a magnetic force to move the blade from side to side when the coil is energized thus cooling the device.

The cooling fan of the present invention may be used to dissipate heat generated by devices of all sizes. For example, the present invention may be used to dissipate heat generated by small sized devices, such as semiconductor devices, by medium sized devices, such as refrigerators, as well as by large sized devices, such as power transformers. For purposes of clarity and simplicity, however, the cooling fan of the present invention will be described using a semiconductor device as the device to be cooled.

Figure 1:
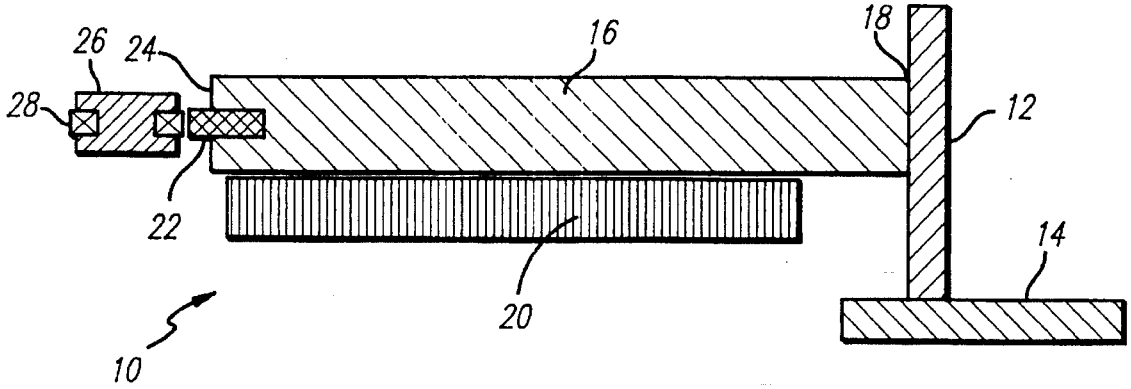
FIG. 1 is a side elevational view of a cooling fan constructed in accordance with the principles of the present invention.

Referring now more specifically to FIG. 1, there is shown a cooling fan 10 for cooling a device 20, such as a semiconductor device, constructed in accordance with the principles of the present invention. As is therein shown, the fan 10 includes a post 12 mounted upon a support 14. The post 12 has a fan blade 16 anchored at one end 18 thereof. The fan blade 16 may be constructed from flexible metal or plastic material such as polyimide (such as Kapton TM available from the E.I., Du Pont de Nemours Company, Wilmington, Del.), polymer (such as Nylon), or polyethylene terephthalate (such as Mylar TM available from the E.I., Du Pont de Nemours Company, Wilmington, Del.). It has been found that if the material from which the fan blade 16 is constructed is extremely smooth along its edges that it will have essentially an infinite life. The fan blade 16 may be of a length sufficient to substantially cover the device 20 to be cooled.

Figure 4:
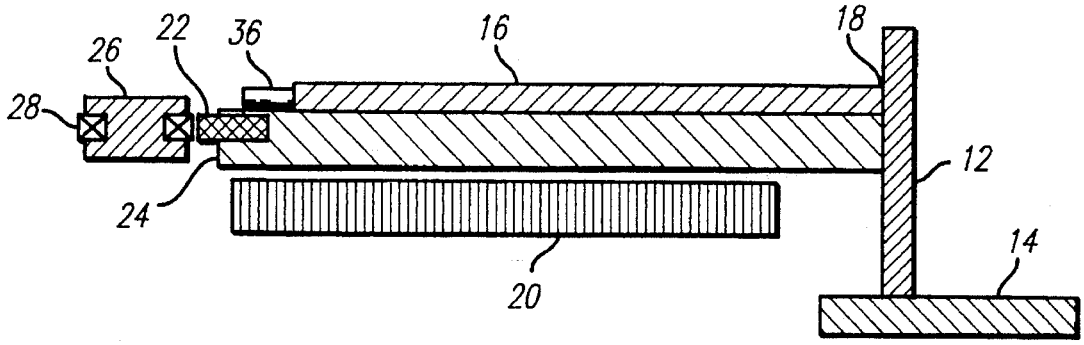
FIG. 4 is a side elevational view of a cooling fan including a position sensor constructed in accordance with the principles of the present invention.
Figure 5:
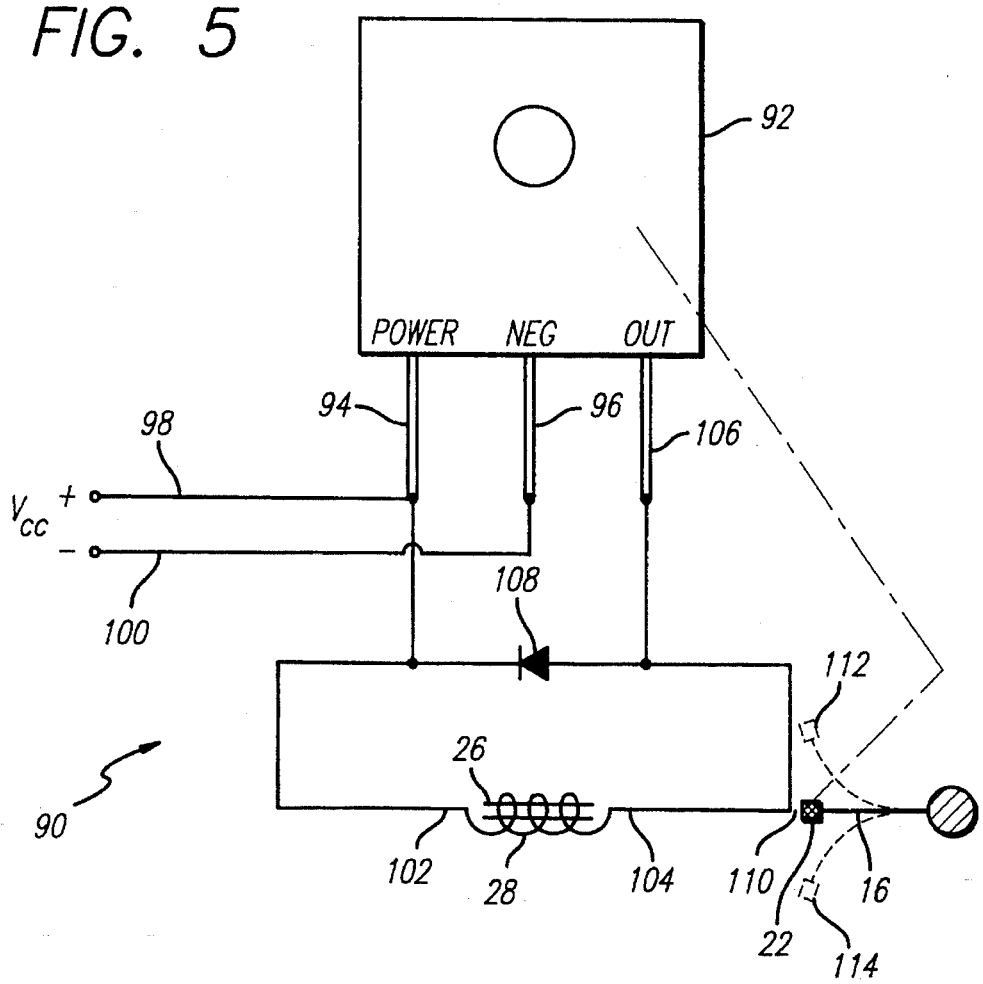
FIG. 5 is a schematic diagram illustrating a Hall-effect sensor for providing position sensing to a cooling fan in accordance with the principles of the present invention.
Figure 6:
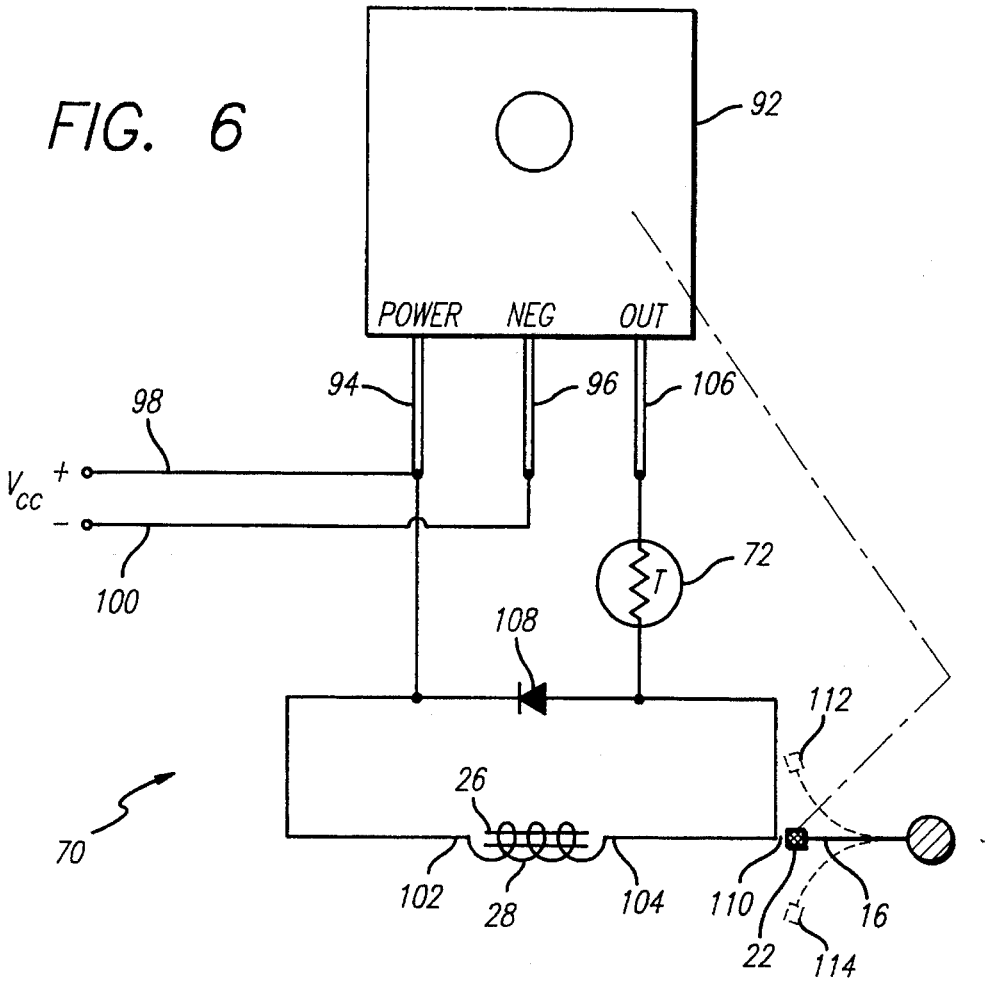
FIG. 6 is a schematic diagram illustrating an alternative embodiment of a Hall-effect sensor for providing position sensing to a cooling fan in accordance with the principles of the present invention.

A permanent magnet 22 is affixed to the opposite end 24 of the blade 16. As is clearly illustrated in FIGS. 1 and 2, a coil 28 disposed about a core 26 constructed of magnetically permeable material, such as soft or powdered iron core, is disposed adjacent the permanent magnet 22 to provide magnetic force to move the blade 16 from side 32 to side 34 when the coil 28 is energized. An external drive mechanism, such as a position sensor 36 as is shown in FIG. 4 or in particular, a Hall-effect position sensor 92, as is shown in FIGS. 5 and 6 and described in detail below, provide a drive pulse to the coil 28. Alternatively, as is shown in FIGS. 7–10 and described in detail below, an oscillator circuit may be used to provide a drive pulse to the coil 28.

In accordance with the principles of the present invention, a position sensor 36 as is shown in FIG. 4 and described in detail below may be positioned adjacent to the magnet 22 for providing position sensing feedback information for powering the fan blade. A number of devices may be used for position sensing, including Hall-effect, optical interrupter and capacitance devices. In operation, the position of the fan blade 16 is sensed by a position sensor 36, such as a Hall-effect sensor, which operates to supply a drive pulse to the coil 28, interrupted by the action of the magnet 22 as it passes by.

By referring now more particularly to FIG. 5, there is illustrated and will be described more in detail, one embodiment of a cooling fan 90 including a Hall-effect sensor 92 for providing position sensing feedback information. The Hall-effect sensor 92 may be a conventional commercially available Hall-effect sensor, such as a model number 3113ua sold by Allegro, Inc. of Worcester, Mass. In particular, the Hall-effect sensor 92 may be suspended above or below the fan blade 16, adjacent to the magnet 22 on the fan blade 16, so that when the magnet 22 swings by the Hall-effect sensor 92, the magnet 22 switches the Hall-effect sensor 92 on and off. As is shown in FIG. 5, the power 94 and negative 96 terminals of the Hall-effect sensor 92 are connected to the positive 98 and negative 100 terminals of an external voltage supply $V_{cc}$, respectively. One end 102 of the coil 28 is connected to the power terminal 94 of the Hall-effect sensor 92. The other end 104 of the coil 28 is connected to the output terminal 106 of the Hall-effect sensor 92. Connected between the power terminal 94 and the output terminal 106 is a catch diode 108 for protecting the Hall-effect sensor 92 from the reverse current spikes which may occur if the magnetic field of the coil 28 collapses.

In operation, the Hall-effect sensor 92 is arranged so that it switches on when the fan blade is approximately at a center position 110. When the Hall-effect sensor 92 is switched on, power is applied and the coil 28 generates a magnetic field which is opposite to the magnetic field generated by the magnet 22. The magnet 22 reacts to the magnetic field generated by the coil 28, causing the fan blade 16 to move away from the center position 110 towards side 112 or 114. When the fan blade 16 moves away from the center position 110, towards side 112 or 114, the Hall-effect sensor 92 switches off. The fan blade 16 returns to the center position 110 by its own restoring force, with the momentum of the fan blade 16 typically carrying the fan blade 16 past the center position 110 towards the opposite direction. While approximately at the center position 110, the Hall-effect sensor 92 switches on and applies a kick to the fan blade 16. In particular, when the magnet 22 returns by its own restoring force towards the center position 40, a voltage is induced in the coil 28, thus causing current to flow through the coil 28 to apply a kick or power pulse of magnetic energy to the blade 16. The magnet 22 reacts to the magnetic field generated by the coil 28, causing the fan blade 16 to move away from the center position 110 towards the side. This process continues as the fan blade 16 moves from side 112 to side 114, causing air to be moved over a device to be cooled. Eventually, the fan blade 16 becomes synchronized at its natural resonant frequency.

The physical configuration of a cooling fan resonant at 38 Hz and constructed in accordance with the invention shown in FIG. 5 will now be described. The fan blade 16 was constructed from Mylar material and was approximately 0.007 inch thick, 1 inch long and 0.4 inch wide. The magnet 22 was approximately 0.125 inch by 0.125 inch. The coil 28, constructed from #36 wire and having a resistance of 55 ohms, was approximately 1 inch long and 0.4 inch wide. The core 26 of the coil 28 was constructed from soft iron. The Hall-effect sensor 92 was a model number 3113ua sold by Allegro, Inc. of Worcester, Mass.

During operation of the cooling fan, constructed in accordance with the above specifications, the angular displacement of the blade tip was approximately 130 degrees. The power required was 13 volts dc, with an average current of 8–10 milliamps, including 4.7 milliamps required by the Hall-effect sensor 92.

By referring now more particularly to FIG. 6, there is illustrated and will be described in more detail, an alternative embodiment of a cooling fan 70 including a Hall-effect sensor 92 for providing position sensing feedback information constructed in accordance with the principles of the present invention. It is noted that the cooling fan 70 of FIG. 6 is substantially the same as the cooling fan 90 of FIG. 5 with the exception that the cooling fan 70 of FIG. 6 includes a thermistor 72 having a very high temperature coefficient of resistance for maintaining the current through the coil 28 constant. As is well known to those skilled in the art, a thermistor works as a temperature compensating device by automatic adjustment of its resistance, down or up, as working temperatures rise or fall, respectively, and resistances of other components in the circuit rise or fall. For example, the resistance of the coil 28, preferably constructed from copper increases with temperature and vice versa. The resistance of the thermistor 72 decreases with increasing temperature and vice versa. To compensate for the temperature effects on the coil 28, the thermistor 72 is placed in contact with the coil 28. In particular, as is shown in FIG. 6, the thermistor 72, placed in series with the coil 28, balances the effect of changes in temperature on the coil 28 by showing a reduction in resistance with increasing temperature. As previously noted, the cooling fan 70 of FIG. 6 is substantially similar to the cooling fan 90 of FIG. 5 and thus will not be discussed in detail at this point.

Figure 7:
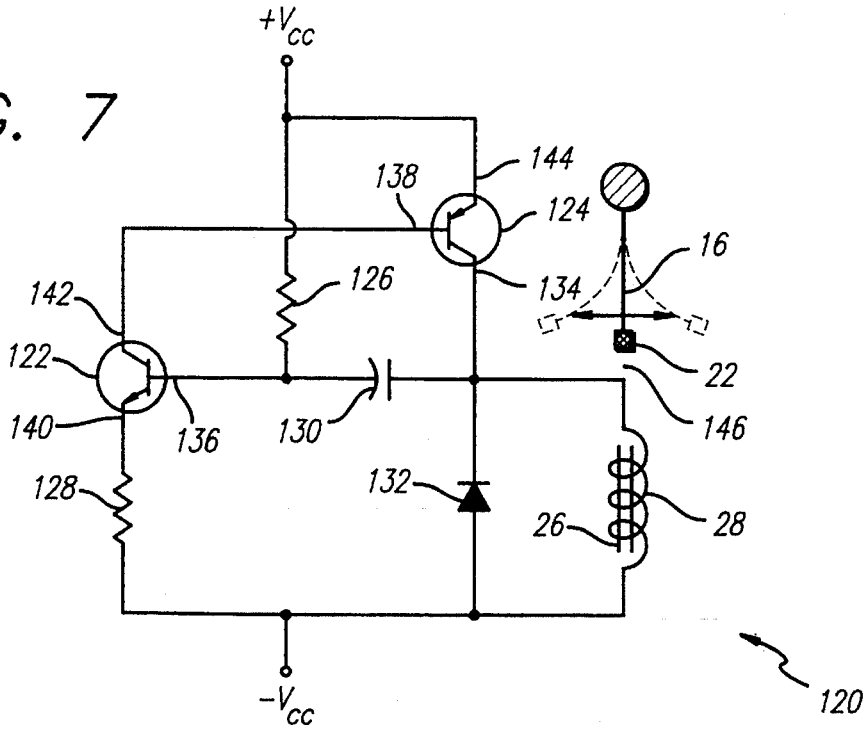
FIG. 7 is a schematic diagram illustrating an astable oscillator circuit for providing power to a cooling fan in accordance with the principles of the present invention.

In an alternative embodiment of the invention, an oscillator circuit, such as the astable oscillator circuit 120 illustrated in FIG. 7 and described in detail below, may be used to provide power to the cooling fan in accordance with principles of the present invention. By referring now more particularly to FIG. 7, there is illustrated and will be described in more detail, one embodiment of an astable oscillator circuit 120 for generating an oscillating current having a frequency of oscillation synchronized to the natural resonant frequency of the fan blade 16. As is shown in FIG. 7, astable oscillator circuit 120 includes bipolar transistors 122 and 124, resistors 126 and 128, capacitor 130, catch diode 132 and coil 28. Transistor 122 is a NPN transistor in a common emitter configuration; transistor 124 is a PNP transistor in a common emitter configuration. Transistors 122 and 124 may be conventional commercially available NPN and PNP transistors, respectively.

During startup, the fan blade 16 is stationary and provides no back EMF voltage in the coil 28. The coil 28, connected in series with the capacitor 130, looks like a low impedance ground to capacitor 130. The resistor 126 charges the capacitor 130 until the base 136 of transistor 122 is slightly forward biased and the transistor 122 begins to conduct. The current on the collector 142 of transistor 122 turns on transistor 124 which provides drive current to the coil 28 and to the base 136 of transistor 122 through capacitor 130. The voltage across the capacitor 130 increases until the base 136 of transistor 122 is no longer forward biased. When transistor 122 turns off, transistor 124 also turns off and the voltage across the coil 28 falls to zero. The charge on the capacitor 130 pulls the base 136 of transistor 122 to about 10 volts negative. The resistor 126 charges the capacitor 130 until the base 136 of transistor 122 is slightly forward biased and the process repeats. The pulses on the coil 28 thus cause the fan blade 16 to begin to oscillate. Catch diode 132, connected at the output between the collector 143 and $-V_{cc}$, protects the transistors 122 and 124 from reverse current spike which may occur if the magnetic field of the coil 28 collapses.

In operation, a small voltage is induced in the coil 28 when the magnet 22 on the fan blade 16 moves across the coil 28. In particular, when the magnet 22 approaches the coil 28, a small negative voltage is generated. Since the capacitor 130 is in series with the coil 28, the negative voltage is added to the voltage across the capacitor 130 and applied to the base 136 of transistor 122. This negative voltage helps to keep transistor 122 from turning on. After the magnet 22 approximately passes the center position 146, the generated voltage is positive. This helps transistor 122 turn on. The current on the collector 142 of transistor 122 turns on transistor 124 which provides drive current to the coil 28, causing the magnet 22 to be kicked away from the coil 28. The kicks are therefore synchronized with the movement of the fan blade 16. Transistors 122 and 124 continue to turn each other on and off as long as power is applied to the circuit. The period of oscillation is largely dependent on the value of resistor 126 and capacitor 130. In particular, the off period is largely dependent on the value of resistor 126 and capacitor 130, and the on period is largely dependent on the value of resistor 128 and the capacitor 130. The on period typically comprises 5–10% of the total period.

In accordance with the principles of the present invention, after approximately several periods of oscillation, the oscillator circuit 120 becomes synchronized to the natural resonant frequency of the fan blade 16. In operation, the oscillator 120 may be initially tuned to within approximately 10% of the natural resonant frequency of the fan blade 16. When power is applied to the oscillator circuit 120, the coil 28 is energized thus causing the blade to be placed in motion. In particular, upon energization of the coil 28, a magnetic field is generated which is opposite to the magnetic field generated by the magnet 22. The magnet 22 mounted on the blade 16 reacts to the magnetic field generated by the coil 28, causing the blade 16 to move away from a center position 146, towards side 147 or 148. When the magnet 22 returns by its own restoring force towards the center position 146, the magnet 22 generates a current back into capacitor 130 (limited to an amplitude of approximately 0.7 volts by catch diode 132). This action tends to shift the frequency of the oscillator circuit 120 to the natural resonant frequency of the fan blade 16. Thus, after approximately several periods of oscillation, the oscillator circuit 120 becomes synchronized to the natural resonant frequency of the fan blade 16.

The physical configuration of a cooling fan resonant at 38 Hz and constructed accordance with the invention shown in FIG. 7 will now be described. The fan blade 16 was constructed from Mylar and was approximately 0.007 inch thick, 1 inch long and 0.4 wide. The magnet 22 was approximately 0.125 inch by 0.125 inch. The coil 28, constructed from #36 wire and having a resistance of 55 ohms, was approximately 1 inch long and 0.4 inch wide. The core 26 of the coil 28 was constructed from soft iron. The transistor used for transistor 142 was a model number 2N2222 sold by Motorola, Inc. of Phoenix, Ariz. The transistor used for transistor 144 was a model number 2N2907 sold by Motorola, Inc. of Phoenix, Ariz. The diode used for diode 132 was a model number 1N4001 sold by Motorola, Inc. of Phoenix, Ariz. Typical values of other components are shown below in TABLE 1:

TABLE 1

| COMPONENT | TOLERANCE |
|---|---|
| Resistor 126 | 1 megaohm |
| Resistor 128 | 100 ohm |
| Capacitor 130 | 0.047 uF |

The oscillator circuit 120 described hereinabove and illustrated in FIG. 7 is not limited to what has been shown and described. For example, the transistors 142 and 144, diode 132 and other components are not limited to the what has been shown and described. Rather, other equivalent or similarly conventional commercially available products may be used as well. Additionally, the oscillating circuit 120 may be implemented using junction or MOS field-effect transistors, instead of bipolar transistors.

By referring now more particularly to FIG. 8, there is illustrated and will be described in more detail, an alternative embodiment of an astable oscillator circuit 50 for generating an oscillating current having a frequency of oscillation synchronized to the natural resonant frequency of the fan blade 16 constructed in accordance with the principles of the present invention. It is noted that the oscillator circuit 50 of FIG. 8 is substantially the same as the oscillator circuit 120 of FIG. 7 with the exception that the oscillator circuit 50 of FIG. 8 includes a thermistor 52 having a very high temperature coefficient of resistance for maintaining the current through the coil 28 constant. As previously noted, a thermistor works as a temperature compensating device by automatic adjustment of its resistance, down or up, as working temperatures rise or fall, respectively, and resistances of other components in the circuit rise or fall. For example, the resistance of the coil 28, preferably constructed from copper, increases with temperature and vice versa. The resistance of the thermistor 52 decreases with increasing temperature and vice versa. To compensate for the temperature effects on the coil 28, the thermistor 52 is placed in contact with the coil 28. In particular, as is shown in FIG. 8, the thermistor 52, placed in series with the coil 28, balances the effect of changes in temperature on the coil 28 by showing a reduction in resistance with increasing temperature. Additionally, a thermistor may be used to counteract fluctuations in value of other components, such as resistors, in an oscillating circuit due to heating effects or temperature changes. As previously noted, the oscillator circuit 50 of FIG. 8 is substantially similar to the oscillator circuit 120 of FIG. 7 and thus will not be discussed in detail at this point.

In an alternative embodiment of the invention, a 555 timer 150 as is shown in FIG. 9 may be connected in a free-running mode to generate a periodic substantially rectangular pulse at the output (pin 3) for providing power to the cooling fan in accordance with principles of the present invention. The 555 timer 150 may be a conventional commercially available 555 timer, such as a model sold by Signetics of Santa Clara, Calif. The circuit 152 shown in FIG. 9 is typically referred to as an astable multivibrator. As is well known to those skilled in the art, to make the 555 timer 150 an astable multivibrator circuit 152, threshold and trigger pins (6 and 2) are connected together, forcing the circuit 152 to be self-triggering. Operation of the 555 timer 150 connected in the free-running mode is well known to those skilled in the art and will not be described in detail.

The frequency of oscillation is largely determined by the resistor 158 and the capacitor 154, while the on time for the coil 28 is largely determined by the resistor 160 and the capacitor 154. The output (pin 3) of the 555 timer 150 is normally high (near $+V_{cc}$), thus causing the coil 28 to be returned to the positive supply, rather than the negative supply. In accordance with the principles of the present invention, the back current from the coil 28 may be coupled through a capacitor 174 into the auxiliary control voltage input (pin 5) provided on the 555 timer 150. Additionally, if the natural period of the circuit 152 is tuned to within approximately 10% of the natural resonant frequency of the fan blade 16, then the back current causes the oscillator 152 to lock onto the natural resonant frequency of the fan blade 16 within approximately several cycles.

The physical configuration of a cooling fan resonant at 38 Hz and constructed in accordance with the invention shown in FIG. 9 will now be described. The fan blade 16 was constructed from Mylar and was approximately 0.007 inch thick, 1 inch long and 0.4 inch wide. The magnet 22 was approximately 0.125 inch by 0.125 inch. The coil 28, constructed from #36 wire and having a resistance of 55 ohms, was approximately 1 inch long and 0.4 inch wide. The core 26 of the coil 28 was constructed from soft iron. The 555 timer 150 was manufactured by Signetics of Santa Clara, Calif. Typical values of other components are shown below in TABLE 2:

TABLE 2

| COMPONENT | TOLERANCE |
|---|---|
| Resistor 158 | 1 megaohm |
| Resistor 160 | 33K ohm |
| Capacitor 154 | 0.033 uF |
| Capacitor 174 | 0.15 uF |

By referring now more particularly to FIG. 10, there is illustrated and will be described in more detail, an alternative embodiment of a circuit 60 for providing power to the cooling fan in accordance with principles of the present invention. It is noted that the circuit 60 of FIG. 10 is substantially the same as the circuit 152 of FIG. 9 with the exception that the circuit 60 of FIG. 10 includes a thermistor 62 having a very high temperature coefficient of resistance for maintaining the current through the coil 28 constant. In the preferred embodiment, the thermistor 62 is connected between end 66 of the windings and port 3 of the 555 timer 150. As previously noted, the resistance of the coil 28, preferably constructed from copper increases with temperature and vice versa. The resistance of the thermistor 52 decreases with increasing temperature and vice versa. To compensate for the temperature effects on the coil 28, the thermistor 52 is placed in contact with the coil 28. In particular, as is shown in FIG. 8, the thermistor 52, placed in series with the coil 28, balances the effect of changes in temperature on the coil 28 by showing a reduction in resistance with increasing temperature. Additionally, a thermistor may be used to counteract fluctuations in value of other components, such as resistors, in the circuit due to heating effects or temperature changes, As previously noted, the oscillator circuit 60 of FIG. 10 is substantially similar to the oscillator circuit 152 of FIG. 9 and thus will not be discussed in detail at this point.

It will be noted that the particular geometric configuration of the device 20 to be cooled may be positioned below the fan blade 16 in any manner desired. As is shown in FIGS. 2 and 3, the device 20 to be cooled may be advantageously positioned so that when the blade 16 is moved back and forth, air is caused to be moved over substantially the entire area of the device 20.

Figure 2:
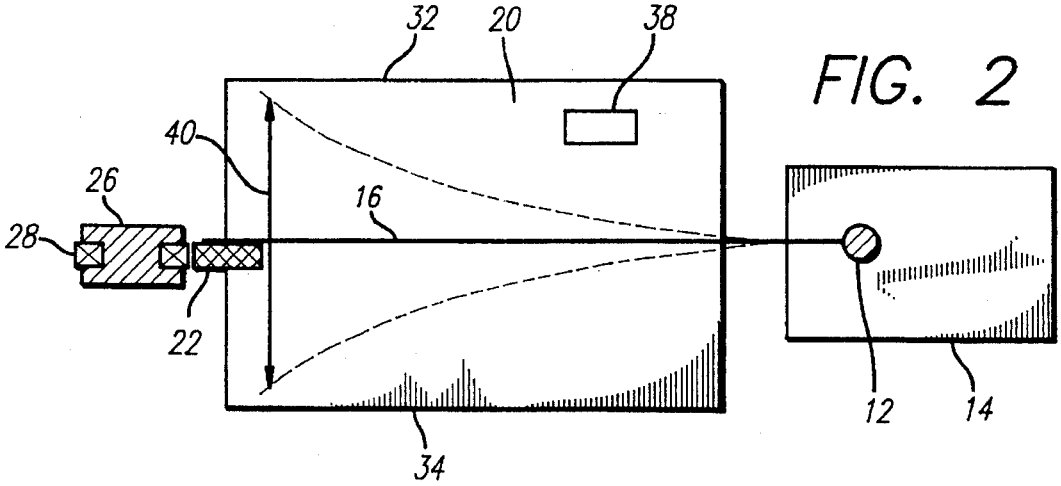
FIG. 2 is a top plan view of the structure illustrated in FIG. 1.
Figure 3:
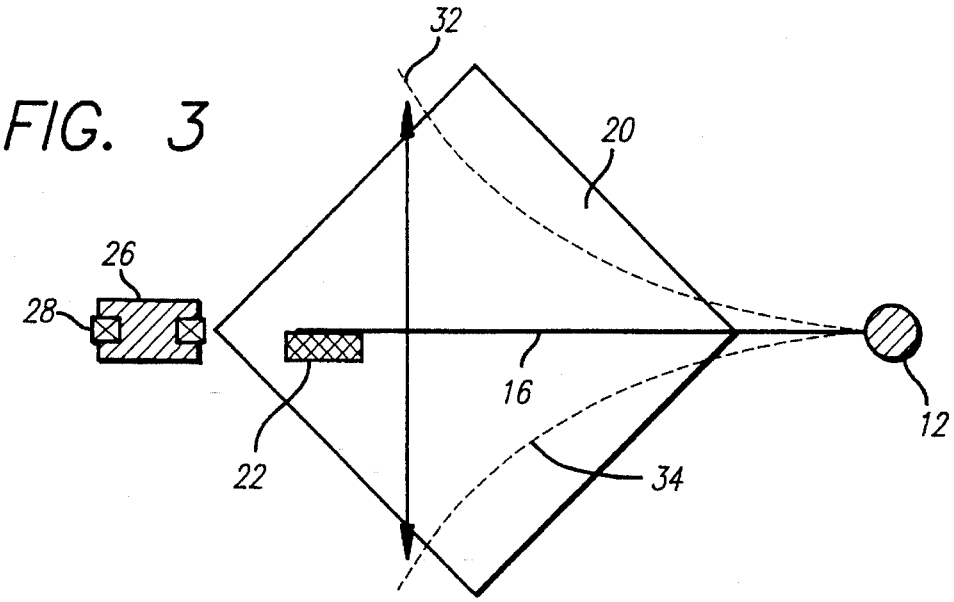
FIG. 3 is a top plan view of an alternative embodiment of a cooling fan constructed in accordance with the principles of the present invention.

By referring now more particularly to FIG. 3, there is illustrated an alternate embodiment for mounting the fan 10 in accordance with the principles of the invention. As illustrated in FIG. 3, the entire fan 10 may be manufactured as a self-supporting unit assembly rather than as mounted on a support structure, such as the support 14 illustrated in FIGS. 1 and 2. The structure of the blade 16 as well as the magnet 22 is substantially the same as above-described and thus will not be described in detail at this point.

In another embodiment of the invention, the fan 10 may be manufactured in such a way as to be clipped over the device 20 to be cooled to interconnect with the electrical connections to the device 20, thereby obtaining its power without any additional wiring.

In a further embodiment of the invention, a temperature sensor 38 as is shown mounted on the device to be cooled in FIG. 2 may be utilized to sense the temperature of the device 20 so that when cooling is not required, the fan 10 is disconnected from power thereby further saving electrical energy.

Figure 12:
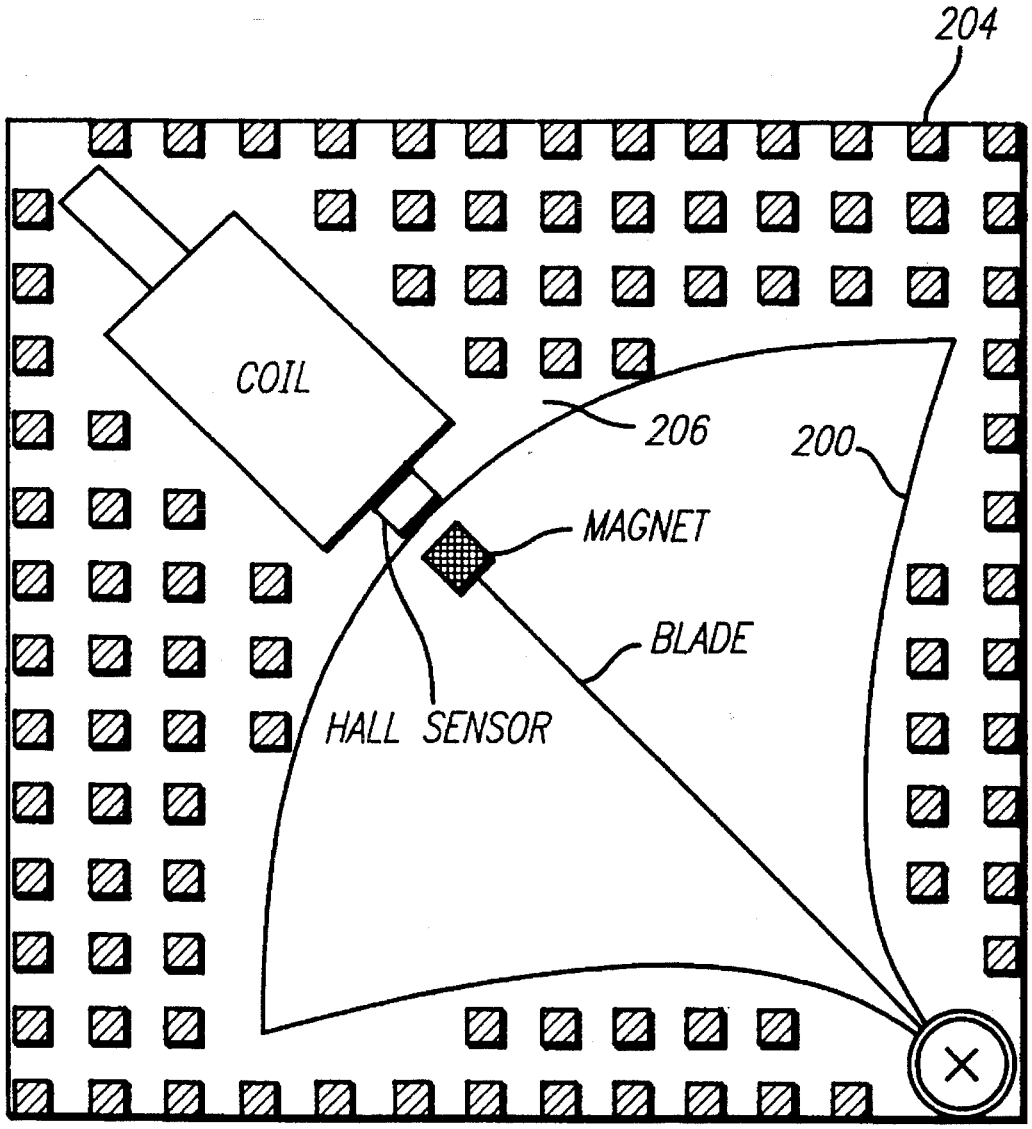
FIG. 12 is a top plan view of the structure illustrated in FIG. 1.

As is shown in FIG. 11, in an alternate embodiment of the invention, a fan assembly 200 may be positioned within a heat sink 202 for enhancing the dissipation of heat generated by a device to be cooled 206, typically a heat generating device such as a semiconductor. As is shown in FIG. 11, the heat sink 202 includes an array of posts 204 for increasing the total surface area from which conduction and radiation into the air can take place. The heat sink 202 may be of a conventional design and is not limited to the design shown in FIG. 11. For example, a conventional heat sink having metal fins, rather than an array of posts may be used. As is shown in FIG. 11, the device to be cooled 206 may be cemented or thermally attached to the base 208 of the heat sink 202. The fan assembly 200, constructed in accordance with the present invention as shown in FIGS. 1–10 and described above, is positioned within the heat sink 202 to enhance convection cooling by blowing cool air past the posts 204. To further increase the surface air and to protect the fan from external disturbances, a top plate 210 may be attached to the array of posts 204. As is shown in FIG. 12, the fan assembly 200 is disposed within a pocket 206 within the array of posts 204 in the heat sink device 202, allowing the fan assembly 200 to blow air in and about and over the array of posts 204 in the heat sink 202.

It will be appreciated by persons skilled in the art that the present invention is not limited to what has been shown and described hereinabove, nor the dimensions of sizes of the physical implementation described immediately above. For example, the present invention is not limited to dissipating heat generated by small devices, such as semiconductor devices. Rather the present invention may be used to dissipate heat generated by medium sized devices, such as refrigerators. In particular, the cooling fan of the present invention may be used to provide low volume, low velocity air from a freezer section to a refrigerator section of a household refrigerator. In as well, the present invention may also be used to dissipate heat generated by large sized devices, such as power transformers. In particular, a large version of the cooling fan may be used for cooling a vertical fin array on a residential power transformer, such as those used for single or multiple household power distribution for underground utilities. The scope of invention is limited solely by the claims which follow.

What is claimed is:

1. A cooling fan for dissipating heat generated by a device to be cooled, comprising:

a flexible fan blade having first and second ends;

a mounting means affixed to one end of said blade for anchoring said blade over said device;

a permanent magnet mounted on the opposite end of said blade;

a coil disposed about a core means constructed of magnetically permeable material and positioned adjacent said permanent magnet for providing a magnetic force to move said blade from side to side when said coil is energized thus cooling said device; and an external drive means for energizing said coil, comprising:

a position sensing means disposed adjacent to said magnet for providing position sensing feedback information.

2. A cooling fan for dissipating heat generated by a device to be cooled as defined in claim 1 wherein said external drive means further comprises:

a power means, and said position sensing means provides power to said coil.

3. A cooling fan for dissipating heat generated by a device to be cooled as defined in claim 2 wherein said position sensing means comprises:

a Hall-effect sensing means for switching said power means on when said magnet is approximately adjacent to said coil, wherein power applied to said coil causes said coil to generate a magnetic field which is opposite to that of a magnetic field generated by said magnet, thus causing said fan blade to move from side to side.

4. A cooling fan for dissipating heat generated by a device to be cooled as defined in claim 1 further comprising:

means for obtaining electrical power from said device to be cooled, thereby minimizing the need for additional wiring.

5. A cooling fan for dissipating heat generated by a device to be cooled as defined in claim 1 wherein said device to be cooled is a semiconductor device.

6. A cooling fan for dissipating heat generated by a device to be cooled as defined in claim 1 wherein said fan blade is constructed from flexible metal material.

7. A cooling fan for dissipating heat generated by a device to be cooled as defined in claim 1 wherein said fan blade is constructed from flexible plastic material.

8. A cooling fan for dissipating heat generated by a device to be cooled as defined in claim 1 wherein said coil is constructed from copper material.

9. A cooling fan for dissipating heat generated by a device to be cooled as defined in claim 1 wherein said magnetically permeable material comprises iron core.

10. A cooling fan for dissipating heat generated by a device to be cooled as defined in claim 1 further comprising:

a heat sink means, disposed about said fan, for increasing the total surface area from which conduction and radiation into air can take place.

11. A cooling fan for dissipating heat generated by a device to be cooled as defined in claim 10 further comprising:

means for disposing said fan within said heat sink means to enhance cooling by blowing cool air through said heat sink means.

12. A cooling fan for dissipating heat generated by a device to be cooled, comprising:

a flexible fan blade having first and second ends;

a mounting means affixed to one end of said blade for anchoring said blade over said device;

a permanent magnet mounted on the opposite end of said blade;

a coil disposed about a core means constructed of magnetically permeable material and positioned adjacent said permanent magnet for providing a magnetic force to move said blade from side to side when said coil is energized thus cooling said device; and an external drive means for energizing said coil, comprising:

oscillator means for generating an oscillating current having a frequency of oscillation synchronized to a natural resonant frequency of said fan blade.

13. A cooling fan for dissipating heat generated by a device to be cooled as defined in claim 12 further comprising:

means for utilizing self-resonance of said fan blade as feedback to synchronize the frequency of said oscillating means to the frequency of said fan blade.

14. A cooling fan for dissipating heat generated by a device to be cooled as defined in claim 13 wherein said means for utilizing self-resonance of said fan blade as feedback to synchronize said oscillating means further comprises:

means for utilizing voltage induced in said coil when said magnet returns to a position close to said coil to provide a pulse to said coil, thus causing a self-induced feedback which in turn locks in the frequency of said oscillating means to said fan blade frequency.

15. A cooling fan for dissipating heat generated by a device to be cooled as defined in claim 4 wherein said oscillator means further comprises an astable oscillator means.

16. A cooling fan for dissipating heat generated by a device to be cooled as defined in claim 15 wherein said astable oscillator means further comprises a 555 timer circuit connected in a free-running mode.

17. A cooling fan for dissipating heat generated by a device to be cooled as defined in claim 16 wherein said feedback means further comprises:

means for coupling back current from said coil into an auxiliary control voltage input on said 555 circuit.

18. A cooling fan for dissipating heat generated by a device to be cooled as defined in claim 17 further comprising:

means for tuning period of said astable oscillator means to within approximately 10% of said natural resonant frequency of said fan blade, thus causing said oscillator to lock onto said natural resonant frequency of said fan blade.

19. A cooling fan for dissipating heat generated by a device to be cooled as defined in claims 12 or 11 further comprising:

a thermistor means operatively connected with said coil for balancing the effect of changes in temperature of said coil by showing a reduction in resistance with increasing temperature.

20. A cooling fan for dissipating heat generated by a device to be cooled as defined in claim 19 wherein said thermistor means is placed in series with said coil for balancing the effect of changes in temperature of said coil by showing a reduction in resistance with increasing temperature.

21. A cooling fan for dissipating heat generated by a device to be cooled, comprising:

a flexible fan blade having first and second ends;

a mounting means affixed to one end of said blade for anchoring said blade over said device;

a permanent magnet mounted on the opposite end of said blade;

a coil disposed about a core means constructed of magnetically permeable material and positioned adjacent said permanent magnet for providing a magnetic force to move said blade from side to side when said coil is energized thus cooling said device;

an external drive means for energizing said coil; and a temperature sensing means coupled to said device for sensing the temperature of said device.

22. A cooling fan for dissipating heat generated by a device to be cooled as defined in claim 21 further comprising:

means responsive to said temperature sensing means for disconnecting said fan from power when cooling is not required.

* * * * *